United States Patent [19]

DiMaio

[11] 3,950,894

[45] Apr. 20, 1976

[54] REINFORCED POLYESTER DOOR

[75] Inventor: Vincent DiMaio, Toledo, Ohio

[73] Assignee: Structural Plastics Incorporated, Toledo, Ohio

[22] Filed: Feb. 22, 1974

[21] Appl. No.: 444,980

[52] U.S. Cl. ..... 49/501; 49/503; 49/394; 52/615; 292/251.5

[51] Int. Cl.[2] ..... E06B 3/22

[58] Field of Search ..... 49/501, 503, 478, 394; 52/615, 629, DIG. 4, 620; 292/251.5

[56] References Cited

UNITED STATES PATENTS

| | | | |
|---|---|---|---|
| 2,871,056 | 1/1959 | Levitt | 49/501 X |
| 3,225,505 | 12/1965 | Lytz | 52/615 |
| 3,243,374 | 3/1966 | Gillard | 52/DIG. 4 UX |
| 3,286,424 | 11/1966 | Weyant | 49/501 X |
| 3,469,349 | 9/1969 | Multer | 49/478 |
| 3,498,001 | 3/1970 | MacDonald | 49/501 |
| 3,753,843 | 8/1973 | Hutchison | 52/615 X |

*Primary Examiner*—Philip C. Kannan
*Attorney, Agent, or Firm*—James D. McNeil

[57] ABSTRACT

A reinforced polyester door is disclosed. The door has an interior supporting frame, rigid front and back surface skins, an insulating foam layer between the front and back surface, and a reinforcing member adjacent the latch side of the door. Magnetizable particles are preferably placed within the front surface skin along the periphery of the door.

8 Claims, 5 Drawing Figures

REINFORCED POLYESTER DOOR

BACKGROUND OF THE INVENTION

This invention relates to an improved construction for a reinforced door structure.

Thermosetting resins have found increasing use not only as surface compositions for desk and counter tops, but also as decorative profile extrusions for replacement of prefinished wood moldings. Products such as window frames, wall panelling, stair rails, siding and doors are now fabricated from plastic and are commercially available. The use of plastic in such applications has been attributed to factors such as shortage of available wood, and the high cost of skilled labor, both of which have contributed to the increase in cost of finished wood products. However, plastic products have certain inherent properties which have stimulated their use as a replacement for wood products. For example, plastics have superior properties such as resistance to denting and marring, resistance to fungi and pest attacks, and resistance to shrinkage and swelling produced by variations in temperature and humidity. In addition, quality control is relatively easy to maintain to insure proper construction to give superior thermal and acoustical insulating properties, along with structural integrity.

These factors have encouraged design engineers and manufacturers to investigate the suitability of various plastics to a wide range of building products. Commercially available plastic doors meet many of the abovementioned criteria; however, dimensional stability, which can be described as resistance to shrinkage and swelling, that is, to deformation under the action of humidity, cold and heat, has been less than satisfactory. This unsatisfactory performance has been especially noticeable when the exterior side of a plastic door is exposed to conditions of high humidity or low temperature, while the interior side is maintained at a comfortable ambient. Warping and bowing of the door can occur, leading to difficulty in opening and closing of the door, and possible structural damage.

SUMMARY OF THE INVENTION

The present invention consists of a reinforced polyester door structure. The improved construction comprises a polyester resin-glass fiber door with a reinforcing member. The door has an interior supporting frame with rigid front and back polyester surface skins, and an insulating foam layer between the surfaces. The metal reinforcing member is positioned vertically along the latch edge of the frame, adjacent the front surface. A plurality of magnetizable particles can be positioned along the periphery of the front surface skin.

It is, therefore, a primary object of the present invention to provide an improved reinforced polyester door structure.

Another object of the invention is to provide a reinforced door structure with an insulating foam interior.

It is another object of the invention to provide a reinforced door structure with magnetizable particles whereby a magnetized gasket may be positioned such that a self-sealing door structure is provided.

Other objects and advantages of the invention will become apparent from the following detailed description.

DESCRIPTION OF THE PREFERRED EMBODIMENTS

Figure 1:
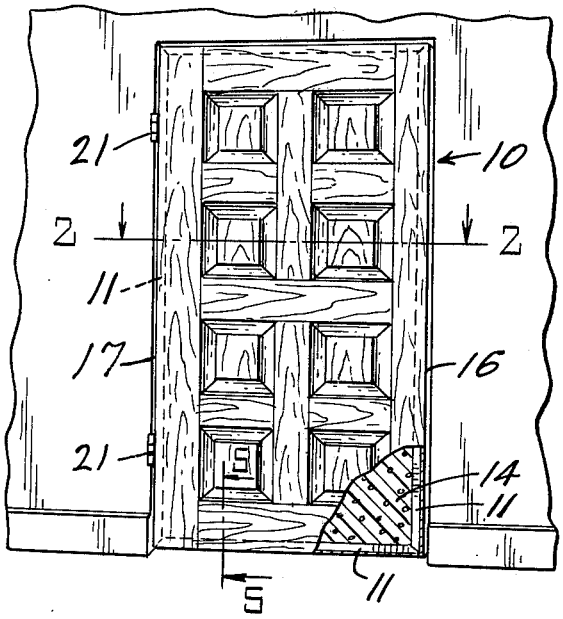
FIG. 1 is a front elevational view of a door structure constructed according to this invention.
Figure 5:
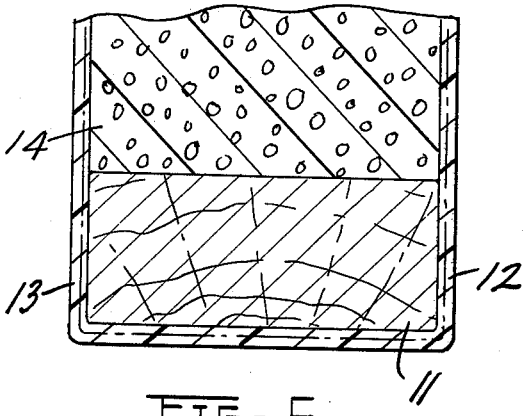
FIG. 5 is an enlarged section taken on the line 5—5 of FIG. 1.

A reinforced polyester door generally designated 10 comprises an interior supporting frame 11, a rigid front surface skin 12, a rigid back surface skin 13, placed in opposed relationship to the surface skin 12, and an insulating foam layer 14 bonded between the back and front surface skins 12 and 13. A metal reinforcing member 15 extends vertically along a latch edge 16 of the frame 11, opposite a hinge edge 17. As shown in detail in FIG. 4, magnetizable particles 18 are placed along the periphery of the front surface skin 12, in a preferred embodiment.

In producing the novel reinforced polyester door of the invention, a female mold, having the configuration desired on the front surface skin 12 is first covered with a polyester resin-glass fiber mixture. Polyester resins are known in the art and are readily prepared by fusing a mixture of phthalic or isophthalic anhydride, maleic anhydride and propylene glycol. After cooling, the polyester resin is cut with 25–50 percent styrene. Unsaturated polyester resins produced in this manner are light-colored solutions which are converted by heat and/or catalysts into a solid infusible mass.

At least one of the molds can be first coated with a gel coat 19 to provide a hard, tough finish. The gel coat, which is a thin outer layer of polyester resin, can include pigments, fillers, silica and tricresyl phosphate. Because silica crystals are highly polished, when the gel coat surface is scratched or scuffed, particles refract light impinging upon them, thus surface damage to the gel coat is not apparent. Fillers are commonly added to a gel coat for economical reasons; fillers commonly used are clays such as bentonite. Tricresyl phosphate can be added to the gel coat to provide a surface that is tack-free when dry. Addition of aluminum chlorhydrate can substantially reduce the burning rate, providing a fire-resistant door.

Materials such as fillers, commonly clays such as bentonite, can be added to the polyester resin. Addition of reinforcing materials, such as chopped glass fibers, to the polyester resin increases the mechanical strength of the plastic door. Optionally, a commercially available bonded glass fiber mat 20 can be placed into the mold and saturated with the polyester resin-glass fiber mixture.

Figure 3:
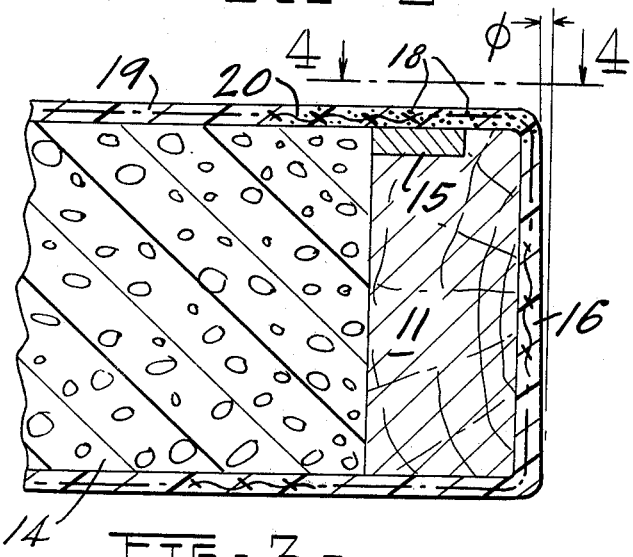
FIG. 3 is an enlarged view of the latch side of the section shown in FIG. 2, showing a glass fiber mat layer and gel coat layer.

The supporting frame 11 is made up of wood or particle board strips secured together about the perimeter of the door 10. Referring to FIG. 3, the supporting frame 11 is fabricated with a recess extending vertically along the latch edge 16 and spaced about ¼ inch from the latch edge. The metal reinforcing member 15, fabricated to fit into the recess, is then held in place while the supporting frame 11 is placed into the female mold, with the metal member adjacent the female mold. Alternately, the metal reinforcing member 15 can be inserted into the recess after the supporting frame 11 is placed in contact with the polyester resin. This helps to coat the reinforcing member 15 with polyester resin. The polyester resin is allowed to cure, integrally bonding the reinforcing member 15 to the polyester front surface skin 12 and to the supporting frame 11. After the polyester resin has cured, the rigid front surface skin 12, the metal reinforcing member 15, and the supporting frame 11, now integrally bonded together as a unit, is removed from the mold.

If it is desired to produce a door having magnetizable particles in the front surface skin 12, magnetizable metal particles 18 are placed into the mold either prior to or subsequent to the addition of the polyester resin. The magnetizable metal particles lie near the surface of the rigid front surface skin 12, necessitating the use of only a small amount of particles to gain significant magnetic properties. For example, it has been found that about one pound of 0.019 spherical metal shot, placed along the periphery, is sufficient. The use of spherical particles is preferred because it has been found that the voids between the spheres tend to define capillary passages which urge the polyester resin into correct position along the critical door edges. Therefore, in the preferred embodiment, spherical metal particles are even placed along the hinge edge 17 where the magnetic sealing properties are not important, because of the synergistic effect with the polyester resin.

Figure 2:
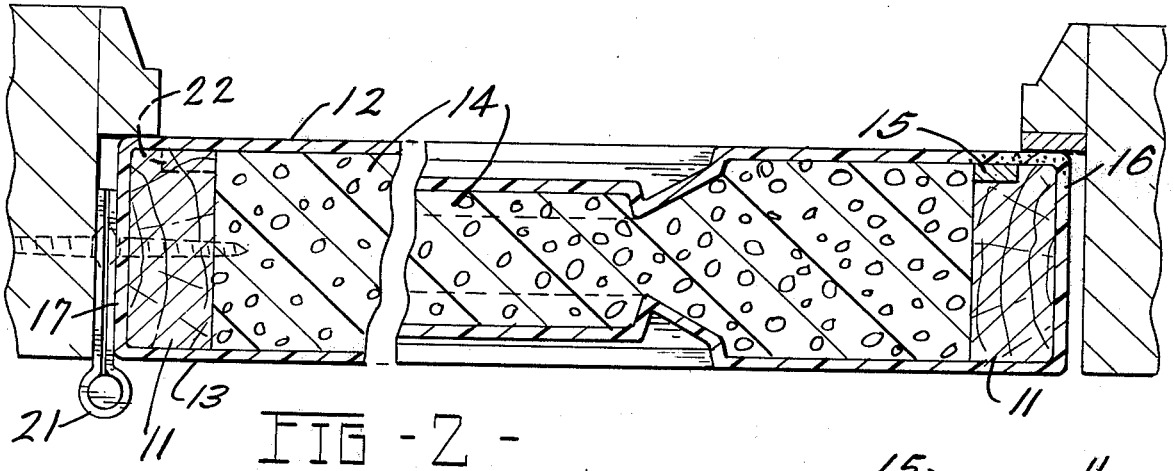
FIG. 2 is an enlarged section, with parts broken away and parts diagrammatically illustrated, taken on the line 2—2 of FIG. 1.

The metal reinforcing member 15 extends along the latch edge 16. The function of the reinforcing member 15 is to prevent bowing of the door which can occur when the temperature of the environment of the front surface skin 12 is lower than the temperature of the environment of the back surface skin 13. Although the polyester resin-glass fiber skin 12 is rigid, the thermal coefficient of expansion is similar to that of low carbon steel. A typical low carbon steel has a thermal coefficient of expansion, given in inch/inch/°F $\times 10^{-6}$ of about 6 to 8, while the polyester resin-glass fiber composition can range from about 10 to 18. Door hinges 21 keep the hinge edge 17 from bowing, thus it is only necessary to place the reinforcing member 15 along the latch edge 16; however, if it is desired to provide extra reinforcing, for example, if the door is to be used in an extremely cold environment, a second reinforcing member 22, shown in dashed lines in FIG. 2, can be placed along the hinge edge 18.

Preferably the mold used to produce the front surface skin 12 includes a lip which extends around the mold periphery. When the mold is coated with the polyester resin-glass fiber mixture, the support frame 11 is also coated. The polyester resin-glass fiber coating on the front face edge and excess coating on the exterior of the support frame 11 is then trimmed, for example by use of a saw or router. This trimming operation produces a uniform thickness of the door structure. In addition, the polyester resin-glass fiber is trimmed off in the same plane as the wood so that when the subsequent bond between the supporting frame 11 and the back skin 13 occurs, a polyester resin - polyester resin bond as well as a polyester resin - wood bond is produced. This bond over a relatively wide area increases the effectiveness of the bond and also encapsulates the support frame 11 with a polyester resin-glass fiber mixture. This encapsulation is an important feature and helps to protect the support frame 11 from adverse effects of moisture, including splitting and delamination of the door structure.

Figure 4:
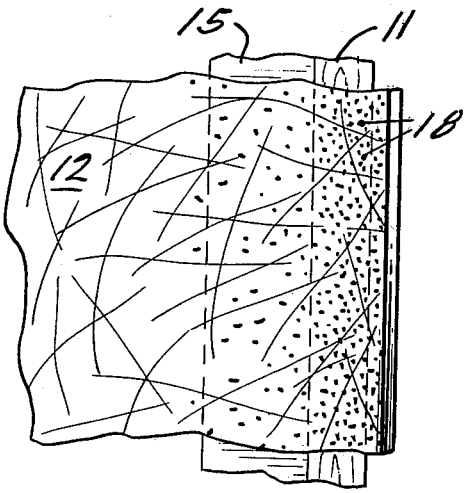
FIG. 4 is a fragmentary sectional view taken on the line 4—4 of FIG. 3, showing metal particles within the front surface skin.

As shown in FIG. 3 and FIG. 4, in the preferred embodiment, the latch side 16 of the door 10 has approximately a 3° bevel indicated as $\phi$. The bevel not only insures a better fitting door, but in producing the front surface skin 12 as described hereinbefore, the bevel $\phi$ gives a draft in the mold which allows for greater ease in pulling the surface skin 12 from the mold.

A somewhat similar procedure is used to produce the back surface skin 13. A female mold, having the desired surface configuration, or a flush surface configuration, is first coated with a polyester resin-glass fiber mixture. The front surface skin 12 bonded to the supporting frame 11 and the reinforcing member 15 as a unit, is then placed into the female mold in contact with the polyester resin. Preferably, a bonded glass fiber mat 20 is placed in the female mold and saturated with the polyester resin-glass fiber mixture. Cure of the polyester resin in contact with the unit referred to above produces a hollow plastic door structure having an encapsulated supporting frame 11, as described above.

Alternatively, more efficient production of the door 10 can be accomplished by allowing the skin 13 to cure to a state that it can be stripped from the mold, and subsequently fully cured. The cured skin 13 and cured unit referred to hereinbefore can then be inspected for quality control before being assembled by "gluing" the skins 12 and 13 together with polyester resin.

A vent hole and a filler hole (not shown) are then drilled through the support frame 11, and the door placed into a mold which conforms to the size of the door. The interior of the door structure is then filled with an insulating heat-curable foam plastic material under low pressure. A foam such as high density polyurethane is suitable for use in the door structure disclosed. This low pressure is sufficient to cause expansion of the front surface skin 12 and the back surface skin 13 to conform to the mold dimensions, thereby producing a straight and flat door. The foam is then cured to produce a unitary door structure. The small holes are then filled to seal the door 10.

Depending upon the use and ornamentation desired, one or both of the surface skins 12 and 13 may have integrally formed therein an embossed surface design, as shown in FIG. 1. Advanced molding techniques can be used to produce a mold reproduction of natural wood graining on the door strikingly similar to hand-carved wood doors. The natural wood graining which can be produced as ornamentation is then preferably treated with color or stain as desired.

The use of the polyurethane foam in conjunction with the complete encapsulating of the interior support frame provides a door structure having enhanced mechanical strength. The door structure 10 is superior to a metal-clad door in resistance to abuse such as denting, scratching and marring. Additionally, inclusion of the metal particles 18, referred to earlier, provides an integral magnetizable layer within the front surface skin 12. The surrounding door frame is fitted with a magnetic weather-strip gasket. As the door is closed against the door frame, the gasket is sufficiently attracted to the metal particles 18 in the front surface skin 12 to cause an excellent weather seal. Inclusion of the magnetizable particles 18 in conjunction with such a magnetic gasket produces a weather-tight door structure which eliminates the necessity of an outside storm door.

What I claim is:

1. A door structure, having a latch edge and a hinge edge, comprising in combination, an interior supporting frame, rigid front and back surface skins formed of polyester resin reinforced with glass fibers positioned in opposed relationship to one another adjacent said frame, an insulating foam layer bonded between said front and back skins within said frame, said supporting frame including a vertically extending recess adjacent said latch edge having a reinforcing member positioned within said recess extending and integrally bonded adjacent said front surface skin along said latch edge, and a plurality of magnetizable particles positioned along at least a portion of the periphery of said front surface skin.

2. A door structure, according to claim 1, wherein the reinforcing member is a steel strap integrally bonded to said front surface skin.

3. A door structure, according to claim 1, wherein said front and back skin each include a reinforcing glass fiber mat layer.

4. A door structure, according to claim 1, wherein the polyester resin includes a filler.

5. A door structure, according to claim 1, wherein said front and back skins include an outer gel coat layer.

6. A door structure, according to claim 1, wherein said front and back skins define a simulated wood carved pattern.

7. A door structure according to claim 1 wherein said front and back surface skins comprise a polyester resin and a glass fiber mat, said polyester resin including a filler.

8. A door structure according to claim 1, having a second vertically extending recess, said second recess being adjacent said hinge edge and a second reinforcing member positioned within said second recess, said second reinforcing member being integrally bonded adjacent said front surface skin.

* * * * *